US006612059B2

(12) United States Patent
Cochran et al.

(10) Patent No.: US 6,612,059 B2
(45) Date of Patent: Sep. 2, 2003

(54) BILLBOARD TAB

(75) Inventors: William H. Cochran, Bangor, MI (US); Andrew G. Hughey, Grand Junction, MI (US)

(73) Assignee: Do-It Corporation, South Haven, MI (US)

( * ) Notice: Subject to any disclaimer, the term of this patent is extended or adjusted under 35 U.S.C. 154(b) by 103 days.

(21) Appl. No.: 09/798,552

(22) Filed: Mar. 2, 2001

(65) Prior Publication Data

US 2002/0121037 A1 Sep. 5, 2002

(51) Int. Cl.[7] ..... G09F 3/10
(52) U.S. Cl. ..... 40/673; 40/674
(58) Field of Search ..... 40/673, 310, 311, 40/674, 124.09, 672, 539

(56) References Cited

U.S. PATENT DOCUMENTS

| | | | | | |
|---|---|---|---|---|---|
| 1,477,123 | A | * | 12/1923 | Hopkins | 40/310 |
| 2,007,685 | A | * | 7/1935 | Lyle | 40/310 |
| 2,250,666 | A | * | 7/1941 | Godefroy | 206/219 |
| 2,758,723 | A | * | 8/1956 | Morris et al. | 206/365 |
| 3,149,431 | A | * | 9/1964 | Blish | 40/310 |
| 3,290,808 | A | * | 12/1966 | Delitz | 248/309.1 |
| 3,352,409 | A | | 11/1967 | Link | |
| 3,370,733 | A | | 2/1968 | Giesler | |
| 3,423,861 | A | * | 1/1969 | Forsyth | 40/310 |
| 3,797,658 | A | * | 3/1974 | Peacock | 206/216 |
| 3,831,300 | A | * | 8/1974 | Berkhouse | 40/124.09 |
| 4,019,632 | A | | 4/1977 | Greenlee | |
| 4,197,894 | A | * | 4/1980 | Boileau | 152/527 |
| D259,252 | S | | 5/1981 | Acker | |
| 4,598,489 | A | * | 7/1986 | Hoffman | 40/310 |
| 4,848,568 | A | | 7/1989 | Eckelman | |
| 5,390,435 | A | * | 2/1995 | Grody | 40/310 |
| 5,598,922 | A | | 2/1997 | Good | |
| 5,728,440 | A | | 3/1998 | Good | |
| 6,321,473 | B1 | * | 11/2001 | Klabunde | 40/310 |

* cited by examiner

*Primary Examiner*—William Miller
(74) *Attorney, Agent, or Firm*—Flynn, Thiel, Boutell & Tanis, P.C.

(57) ABSTRACT

A billboard tab which includes a uniformly thin flat sheet of synthetic resin material having at least first and second sections integrally connected along a mutually adjacent edge by a tearable perforated joint. The first section has a display surface area thereon configured to be oriented at an angle to the second section. The second section has a hole therethrough adjacent a first edge thereof, the hole being oriented adjacent the perforated joint. The second section also has a connecting structure adjacent a second edge remote from the first edge adjacent the hole for facilitating connection of the second section to an object.

17 Claims, 3 Drawing Sheets

BILLBOARD TAB

FIELD OF THE INVENTION

This invention relates to a billboard tab, namely, a display surface adapted to be affixed to a package with an auxiliary feature enabling connection of additional promotional materials without necessitating the reprinting of container labels and the like.

BACKGROUND OF THE INVENTION

It is a common practice when marketing merchandise to offer to the general public promotional items. Placement of the promotional items in the near proximity of the main target item for the promotional marketing program has been problematic. That is, it is difficult to find adequate space on or in and around the merchandise supporting shelving or support mechanisms to facilitate a placement of additional promotional material. Further, the promotional materials have a tendency to disappear without the purchase of the target item which the promotional material is featuring. Thus, it is desirable to provide a marketing tool enabling the placement of promotional material closely adjacent the targeted item of merchandise.

Accordingly, it is an object of this invention to provide a billboard tab featuring a large surface area display and structure for facilitating connection of the display to an article of merchandise.

It is a further object of the invention to provide a billboard tab, as aforesaid, having an additional feature enabling the attachment of promotional material directly to the billboard tab thereby placing it closely adjacent the targeted piece of merchandise.

It is a further object of the invention to provide a billboard tab, as aforesaid, wherein the feature enabling connection of additional promotional materials is in the form of an adhesive containing layer on the billboard tab facilitating easy connection of additional containers and/or promotional materials directly to the billboard tab and thence directly to the targeted piece of merchandise.

It is a further object of the invention to provide a billboard tab, as aforesaid, wherein the feature enabling connection of additional promotional a materials is in the form of a hole or other connecting structure on the billboard tab facilitating easy connection of an additional container and/or promotional materials directly to the billboard tab and thence directly to the targeted piece of merchandise.

It is a further object of the invention to provide a billboard tab, as aforesaid, wherein the mechanism for facilitating attachment of the display surface to the targeted piece of merchandise includes a structure obstructing the removal of it from the targeted piece of merchandise.

SUMMARY OF THE INVENTION

The objects and purposes of the invention are met by providing a billboard tab which includes a uniformly thin flat sheet of synthetic resin material having at least first and second sections integrally connected along a mutually adjacent edge by a perforated joint. The first section defines a display surface configured to be oriented at an angle to the second section at the perforated joint. The second section has a hole therethrough adjacent a first edge thereof. Further, the hole is oriented adjacent the perforated joint. The second section has a connecting structure adjacent a second edge remote from the first edge adjacent the hole for facilitating connection of the second section to an object.

BRIEF DESCRIPTION OF THE DRAWING

Other objects and purposes of this invention will be apparent to persons acquainted with apparatus of this general type upon reading the following specification and inspecting the accompanying drawings, in which.

DETAILED DESCRIPTION

Figure 2:
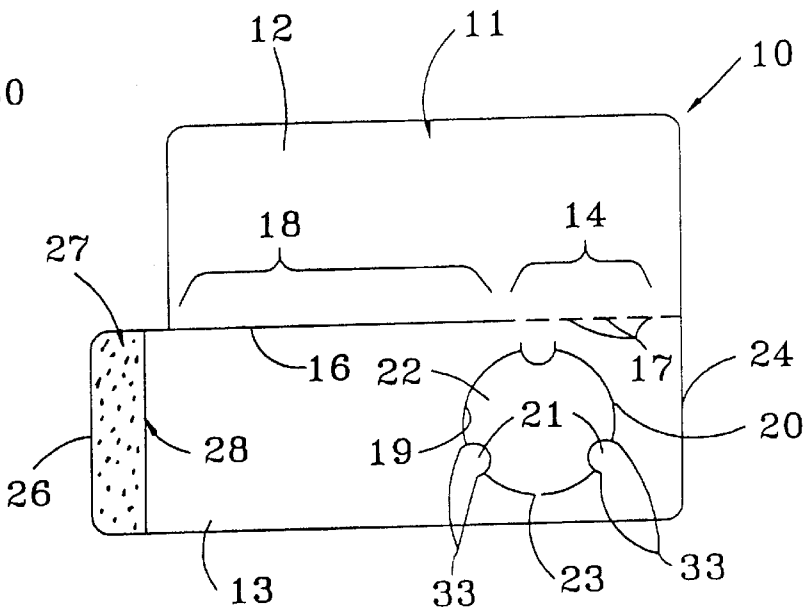
FIG. 2 is a plan view of the billboard tab.

Certain terminology will be used in the following description for convenience and reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

EMBODIMENT OF FIGS. 1 AND 2

Figure 1:
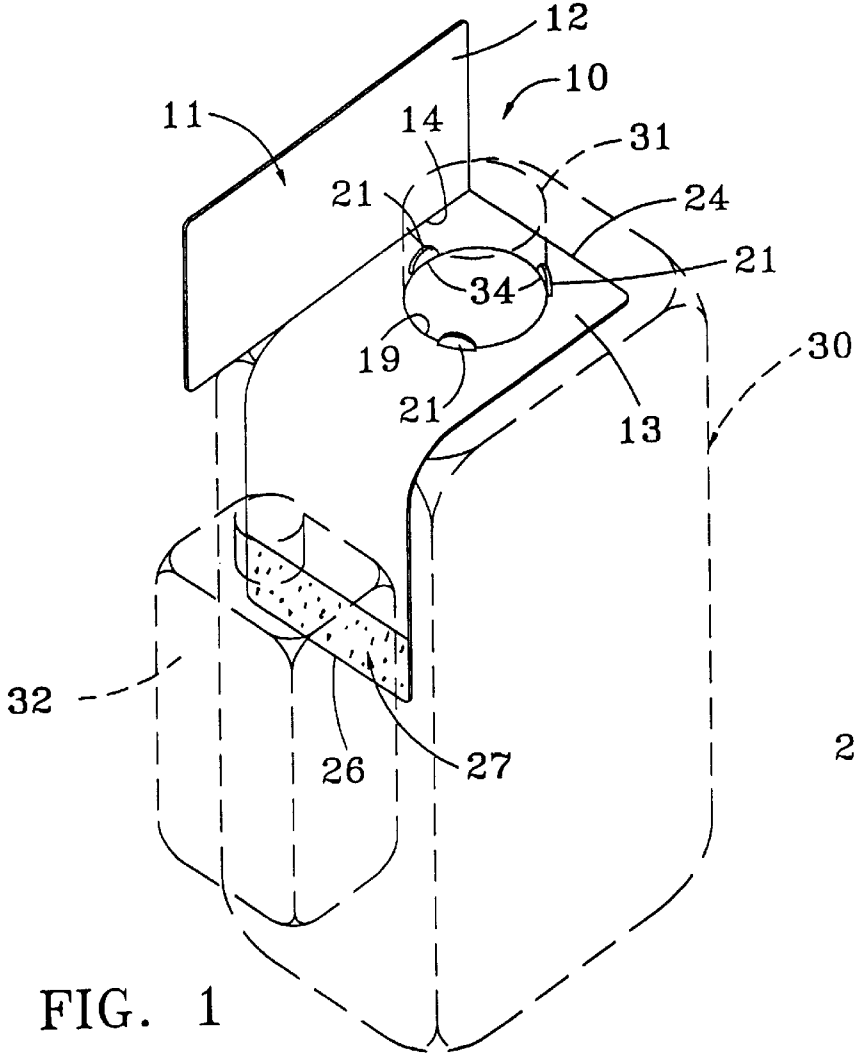
FIG. 1 is an isometric view of a billboard tab embodying the invention.

A first embodiment of a billboard tab 10 embodying the invention is illustrated in FIGS. 1 and 2. The billboard tab 10 is made of a uniformly thin flat sheet of synthetic resin material 11 which, in this particular embodiment, has been divided into first and second elongate side-by-side sections 12 and 13 integrally connected along a first portion 14 of the mutually adjacent edge section 16 between the two sections 12 and 13. In this particular embodiment, the first portion 14 is comprised of a plurality of closely spaced and linearly aligned perforations 17 extending through the flat sheet 11 so as to define a tearable perforated connection there at and a living hinge. The remaining second portion 18 of the mutually adjacent edge section 16 is free of any integrally connected relation between the two sections 12 and 13.

The second section 13 has a hole 19 precut therein as at 20 and extending therethrough, the perimeter of the hole having plural tabs 21 projecting from the perimeter radially inwardly toward the center point of the hole. A hole filling piece 22 occupies the hole and is integrally connected to the flat sheet at one or more very small web links 23. When it is desired to remove the hole filling piece 22, the only structure holding it in place is the aforesaid very small web links 23 so that only a very small force is required on the hole filling piece as it is lifted out of the hole 22 to virtually stretch and then.break the web link connection to the flat sheet 11.

In this particular embodiment, the hole 19 is oriented adjacent one of the short sides 24 of the otherwise generally rectangular configuration for the second section 13. The opposite short side 26 of the second section 13 has a bonding section 27 there at configured for receiving awn adhesive layer 28 thereon. The adhesive layer can be of any conventional type of adhesive, which adhesive after it being applied can be protected by a release liner material not illustrated.

The surface area of the first section 12 is sufficient to print advertising material thereon to form a billboard-like display.

Furthermore, the display surface of the first section 12 is capable of being oriented at an angle with respect to the second section 13 by folding the first section relative to the second section about the living hinge section 14 defined by the linear array of perforations 17 and as shown in FIG. 1.

FIG. 1 illustrates the billboard tab 10 used in association with a container 30 having a neck adapted to receive thereon a cap 31. In this particular embodiment, the neck of the container 31 is inserted in to the hole 19 of the second section 13 after the hole filling piece 22 has been removed therefrom. The diameter of the hole 19 is sized to tightly receive e therein the neck of the container 30. The radially inwardly projecting tabs 21 will be bent upwardly to snugly engage the outer surface of the neck or outer surface of the cap whichever is immediately adjacent thereto so as to serve as friction creating members preventing rotation of the billboard tab 10 about an axis defined by the neck of the container 30 and lift off of the billboard tab 10. In this particular embodiment, the regions 33 of the flat sheet 13 at the perimeter of the hole 19 are precut radially outwardly beyond the perimeter of the hole during the hole forming process so that as the tabs are folded out of the plane of the sheet 13, the radially inwardly facing parts 34 will be generally flushed with the perimeter of the hole as shown in FIG. 1. As is clearly illustrated in FIG. 1, the first section 12 is oriented at approximately a 90° angle relative to the part of the second surface immediately adjacent the living hinge 14 defined by the linear array of perforations 17. The bonding section 27 is adapted to extend along one of the vertical sides of the container 30 with the adhesive material 28 facing outwardly from the container. In this particular embodiment, the promotional item is an additional container 32 having a sidewall area adapted to be adhesively secured to the adhesive material 28 on the bonding section 27 so that the auxiliary promotional item can be prominently displayed adjacent the primary item of marketable merchandise represented by the container 30.

EMBODIMENT OF FIG. 3

Figure 3:
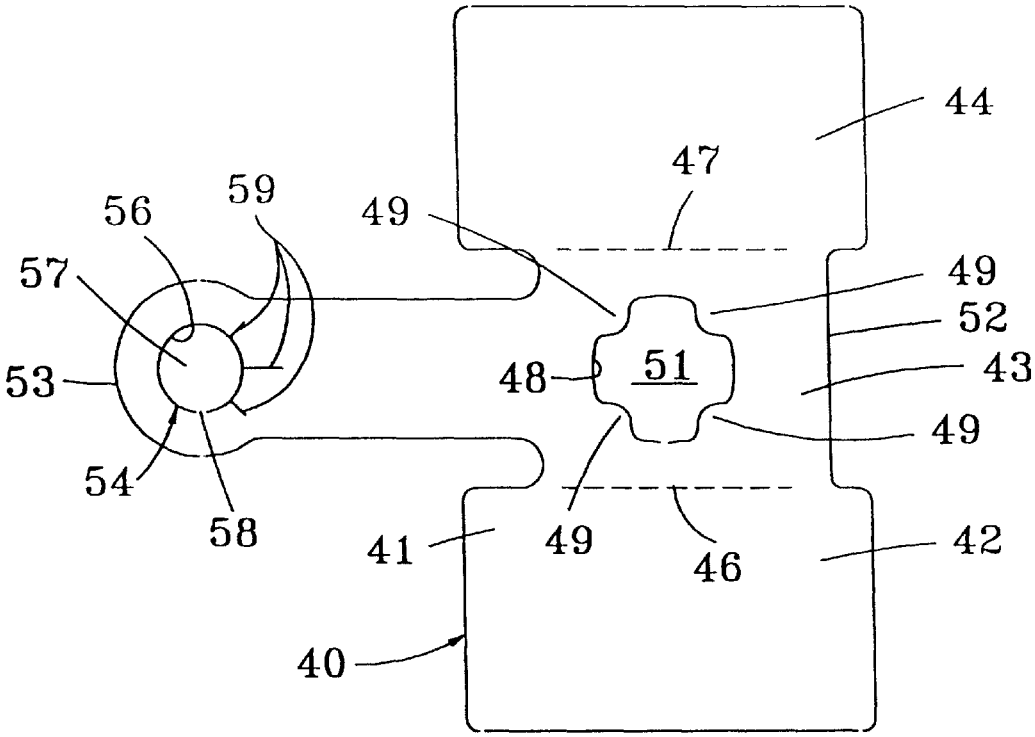
FIG. 3 is a plan view of a second embodiment of the billboard tab.

A second embodiment of a billboard tab 40 embodying the invention is illustrated in FIG. 3. The billboard tab 40 is, like the previous embodiment, made of a uniformly thin flat sheet of synthetic resin material 41 which has been divided into first, second and third elongate side-by-side sections 42, 43 and 44. The first and third sections 42 and 44 are integrally connected to the second section at mutually adjacent edges thereof by respective perforated joints 46 and 47. In this particular embodiment, the perforated joints can be a tearable perforated connection defining a living hinge.

The second section 43 has a hole 48 precut therein and extending therethrough, the perimeter of the hole having plural tabs 49 projecting from the perimeter radially inwardly toward the center point of the hole. A hole filling piece 51 occupies the hole just as does the hole filling piece 22 does in the previous embodiment.

The second section 43 is wider than is each of the first and third sections 42 and 44. The hole 48 is oriented adjacent one of the short sides 52 of the otherwise generally rectangular configuration for the second section 43. The opposite short side 53 of the second section 43 has a connection structure 54 there at which, in this particular embodiment, is a further hole 56. The hole 56 is occupied by a hole filler piece 57 integrally connected to the flat sheet 41 by one or more very small web links 58. If desired, several radially outwardly, extending cuts 59 can be provided at the intersecting perimeter of the hole 56.

Both of the holes 48 and 56 are adapted to receive therethrough the.necks of two separate, containers. The first and third sections 42 and 44, respectively, are configured to have material printed thereon and displayed in close juxtaposition to one of the containers, the neck of which is received in the hole 48 as well as an auxiliary container, the neck of which is received in the hole 57.

EMBODIMENT OF FIG. 4

Figure 4:
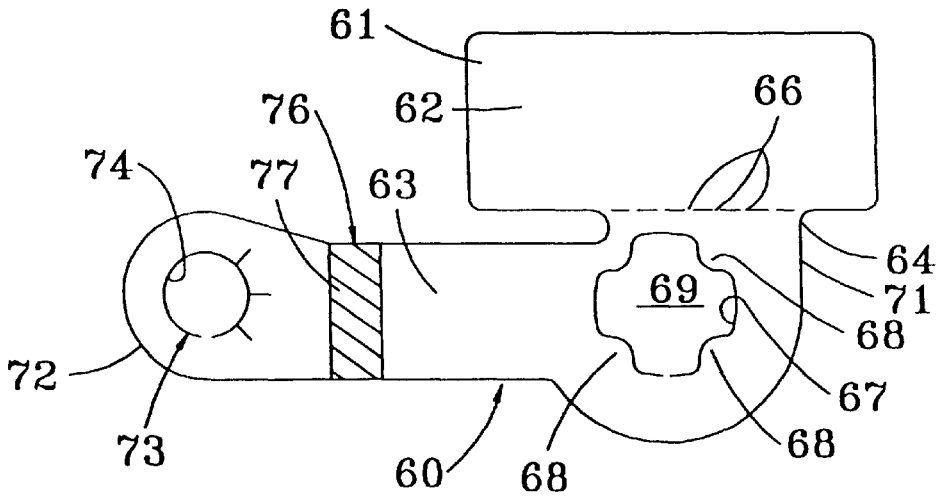
FIG. 4 is a plan view of a third embodiment of the billboard tab.

FIG. 4 illustrates a third embodiment of the billboard tab 60 which, like the embodiment of FIGS. 1 and 2, is made of a uniformly thin flat sheet of synthetic resin material 61. In this particular embodiment, like the embodiment of FIG. 1 and 2, the flat sheet of synthetic resin material 11 has been divided into first and second elongate side-by-side sections 62 and 63 integrally connected along the mutually adjacent edge portion 64 between the two sections 62 and 63. In this particular embodiment, the edge portion 64 is comprised of a plurality of closely spaced and linearly aligned perforations 66 extending through the flat sheet 61 so as to define a tearable perforated connection there at and a living hinge.

The second section 63 has a hole 67 extending therethrough, the perimeter of the hole having a plurality of tabs 68 projecting from the perimeter radially inwardly toward the center point of the hole. A hole filling piece 69 occupies the hole 67 in the same manner as does the filling pieces discussed hereinabove.

The second section 63 is wider than is the first section 62. The hole 67 is oriented adjacent one of the short sides 71 of the otherwise generally rectangular configuration for the second section 63. The opposite short side 72 of the second section 63 has a connection structure 73 there at which, in this particular embodiment is in the form of a hole 74 identical to the hole 56 described above. Intermediate the two holes 67 and 74 is a bonding section configured to receive an adhesive layer 77 of any conventional type. If desired, the adhesive layer 77 can be protected by a release liner material not illustrated.

The surface area of the first section 62 is sufficient to print advertising material thereon to form a billboard-like display. Further, the display surface of the first section 62 is capable of being oriented at an angle with respect to the second section 63 by folding the first section relative to the second section about the living hinge section 64 defined by the linear array of perforations 66 and as shown in FIG. 4.

Necks of two adjacent containers are adapted to be received through respective holes 67 and 74 for joint display on a shelf. The adhesive 77 is adapted to secure to the main container to prevent the auxiliary container, the neck of which is received in the hole 74, from excessive movement relative to the main container.

EMBODIMENT OF FIG. 5

Figure 5:
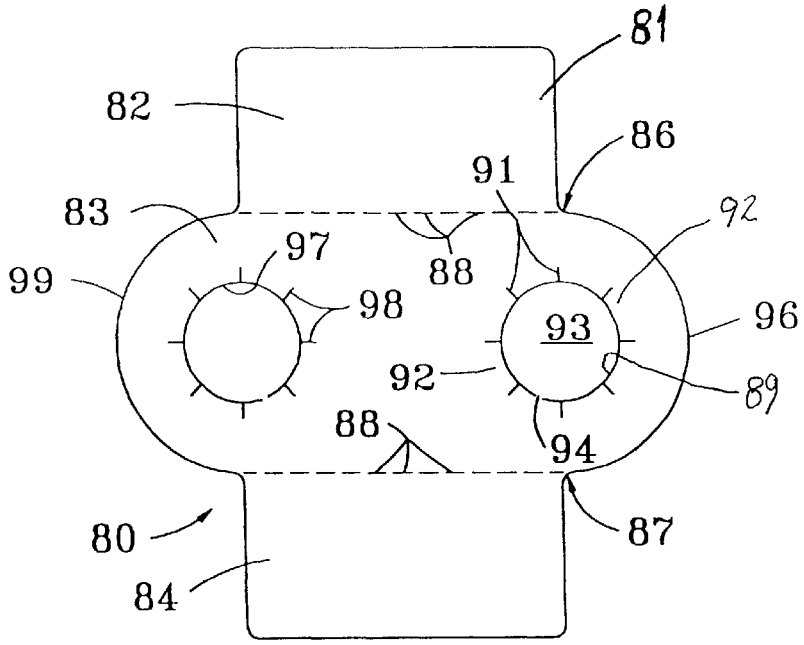
FIG. 5 is a plan view of a fourth embodiment of the billboard tab.

A fourth embodiment of a billboard tab 80 is illustrated in FIG. 5. It like the previous embodiments, is made of a uniformly thin flat sheet 81 of synthetic resin material which has been divided into three side-by-side sections 82, 83 and 84. The first section 82 and the third section 84 are both integrally connected along mutually adjacent edge sections 86 and 87, both of which are comprised of a plurality of closely spaced and linearly aligned perforations 88 extending through the flat sheet 81 so as to define a tearable perforated connection there at and a living hinge.

The second section 83 has a hole 89 precut therein and extending therethrough, the perimeter of the hole having plural radially outwardly extending cuts 91 aligned on a radius of the hole so as to define a plurality of tabs 92. A hole filling piece 93 occupies the hole and is integrally connected to the flat sheet at one or more very small web links 94. A first edge 96 of the second section 83 is arced on a radius having a center point congruent with the center point of the hole 89.

The second section 83 also has a further hole 97 precut therein and extending therethrough, the perimeter of the hole having plural radially outwardly extending cuts 98 so as to make the hole 97 identical in size and configuration to the hole 89. The second edge 99 of the second section 83 is arced on a radius that is congruent with the center point of the hole 97. As is illustrated in FIG. 5, the second section 83 is longer than are the two lengths of the first and third sections 82 and 84, respectively.

The surface area of the first and third sections is sufficient to print advertising material thereon to form billboard-like displays. Furthermore, the display surfaces of the two sections 82 and 84 are capable of being oriented at an angle with respect to the second section 83 by folding the first and third sections 95 relative to the second section about the living hinge sections at the mutually adjacent edges 86 and 87 thereof as shown in FIG. 5.

Both of the holes 89 and 97 are configured to receive the necks of two mutually adjacent containers, the tabs 92 serving to prevent the billboard tab 80 from being removed from the respective containers by reason of interference thereof with the cap on the container.

EMBODIMENT OF FIG. 6

Figure 6:
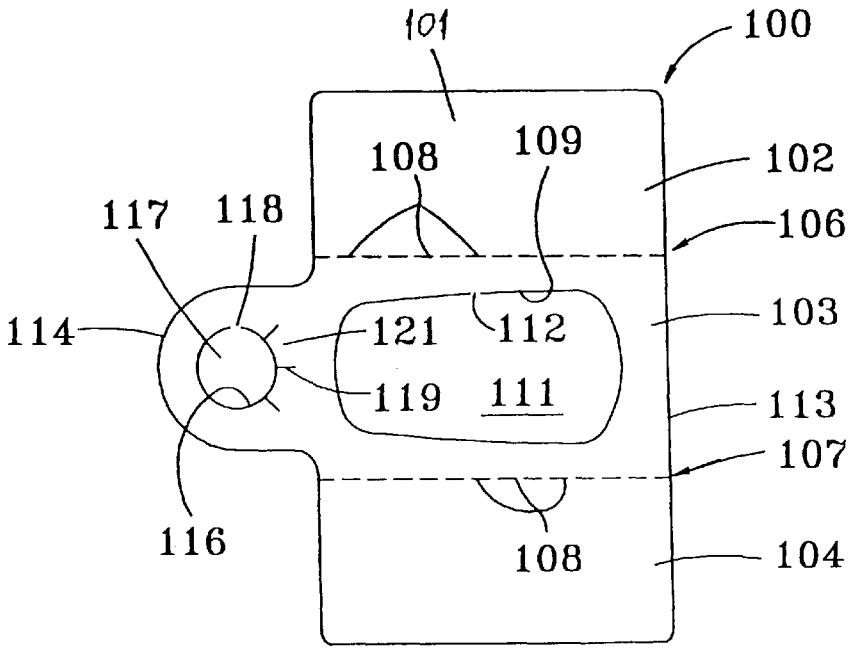
FIG. 6 is a plan view of a fifth embodiment of the billboard tab.

A fifth embodiment of a billboard tab 100 is illustrated in FIG. 6 and is made, like the previous embodiments, of a uniformly thin flat sheet 101 of synthetic resin material. The flat sheet 101 is divided into a first section 102, a second section 103 and a third section 104. The first and third sections are integrally connected to the intermediate second section along mutually adjacent edge sections 106 and 107. The edge sections 106 and 107 have there at a plurality of closely spaced and linearly aligned perforations 108 extending through the flat sheet 101 so as to define a tearable perforated connection there at and a living hinge.

The second section 103 has a hole 109 precut therein and extending therethrough. As is illustrated in FIG. 6, the hole 109 is generally rectangular in shape and occupies a majority of the second section 103. A hole filling piece 111 occupies the hole and is integrally connected to the flat sheet at one or more very small web links 112. A first end or edge 113 of the second section 103 is collinear or aligned with the corresponding edges of the first section 102 and the third section 104. The second end or edge 114 of the second section 103 is oriented beyond the corresponding edges of the first section 102 and the third section 104 and a hole 116 is provided adjacent the edge 114. The second edge 114 is arced on a radius that is congruent with the center point of the hole 116. A hole filling piece 117 occupies the hole 116 and is integrally connected to the flat sheet by one or more very small web links 118. A plurality of radially outwardly extending cuts aligned on a radius of the hole 116 are provided so as to define at least one tab 121.

The surface area of the first section 102 and third section 104 are sufficient to print advertising material thereon to form a billboard-like display. Furthermore, the display surface of the first and third sections is capable of being oriented at an angle with respect to the second section 103 by folding the first and third sections relative to the third section about the living hinge at the mutually adjacent edges 106 and 107.

The hole 109 is configured to receive the neck portion of a container, such as a spray container where the neck is rectangular in configuration as opposed to being circular. The hole 116 is configured circular to receive the neck of a companion container as are the holes in the previously discussed embodiments.

Although particular preferred embodiments of the invention are disclosed in detail for illustrative purposes, it will be recognized that variations or modifications of the disclosed apparat us, including the rearrangement of parts, lie within the scope of the present invention.

What is claim is:

1. A billboard tab, comprising:

a uniformly thin flat sheet of synthetic resin material having at least first and second elongate side-by-side sections integrally connected only along mutually adjacent edges of said first and second sections by a perforated joint, said first section defining a display surface configured to be oriented at an angle to said second section by bending said first section relative to said second section about a living hinge provided at said perforated joint, said second section having a first hole therethrough adjacent a first edge thereof, said first hole further being oriented adjacent said perforated joint, said second section having a length thereof being unattached to said first section along said mutually adjacent edges and a connecting means adjacent a second edge remote from said first edge adjacent said first hole and remote from said perforated joint for facilitating connection of said second section to an object.

2. The billboard tab according to claim 1, wherein said perforated joint is defined by a plurality of closely spaced linary aligned perforations through said flat sheet.

3. The billboard tab according to claim 1, wherein said first and second sections are rectangularly shaped, each having long sides and short sides, said mutually adjacent edges of said first and second sections being oriented along opposed long sides, said perforated joint being provided only on a fragment of said long sides.

4. The billboard tab according to claim 3, wherein said second elongate section is longer than said first elongate section.

5. The billboard tab according to claim 3, wherein said connecting means is a bonding section configured for receiving an adhesive layer thereon.

6. The billboard tab according to claim 5, wherein said bonding section is rectangularly shaped and has a pair of long sides extending parallel to said second edge and a pair of short sides oriented coextensively with a fragment of said long sides of said second section adjacent said second edge.

7. The billboard tab according to claim 7, wherein said second edge of said second section is arced on a radius having a center point congruent with a center point of second hole.

8. The billboard tab according to claim 8, wherein said first edge of said second section is arced on a radius having a center point of said hole.

9. The billboard tab according to claim 8, wherein said first edge of said second section is acred on a radius having a center point congruent with a center point first hole.

10. A billboard tab, comprising:

a uniformly thin flat sheet of synthetic resin material having at least first and second sections integrally connected only along mutually adjacent edges of said first and second sections by a perforated joint configured to provide both a living hinge and a tearable connection thereat, said first section defining a display surface configured to be oriented at an angle to said second section by bending said first section relative to said second section about said living hinge provided at said perforated joint, said second section having a length thereof being unattached to said first section along said mutually adjacent edges and, having a hole therethrough adjacent a first edge thereof, said hole further being oriented adjacent said perforated joint, whereby said first section can be detached from said second section by tearing along said perforated joint.

11. The billboard tab according to claim 10, wherein said perforated joint is defined by a plurality of closely spaced, linearly aligned perforations through said flat sheet.

12. The billboard tab according to claim 10, wherein said first and second sections are both elongate and rectangularly shaped, each having long sides and short sides, said mutually adjacent edges being oriented along opposed long sides.

13. The billboard tab according to claim 12, wherein said second elongate section is longer than said first elongate section.

14. The billboard tab according to claim 10, wherein said second section has a connecting means adjacent a second edge remote from said first edge adjacent said hole for facilitating connection of said second section to an object; and wherein said connecting means is a bonding section configured for receiving an adhesive layer thereon.

15. The billboard tab according to claim 10, wherein said second section has a connecting means adjacent a second edge remote from said first edge adjacent said hole for facilitating connection of said second section to an object; and wherein said connecting means is a second hole through said second section.

16. The billboard tab according to claim 15, wherein said second edge of said second section is arced on a radius having a center point congruent with a center point of said second hole.

17. The billboard tab according to claim 16, wherein said first edge of said second section is arced on a radius having a center point congruent with a center point of said first hole.

* * * * *

UNITED STATES PATENT AND TRADEMARK OFFICE

CERTIFICATE OF CORRECTION

PATENT NO. : 6,612,059 B2
DATED : September 2, 2003
INVENTOR(S) : William H. Cochran et al.

It is certified that error appears in the above-identified patent and that said Letters Patent is hereby corrected as shown below:

Column 6,
Lines 52-61, please cancel claims 7-9, and replace with the following:

7. The billboard tab according to Claim 1,
wherein said connecting means is a second hole through said second section.

8. The billboard tab according to Claim 7,
wherein said second edge of said second section is arced on a radius having a center point congruent with a center point of said second hole.

9. The billboard tab according to Claim 8,
wherein said first edge of said second section is arced on a radius having a center point congruent with a center point of said first hole.

Signed and Sealed this

Thirteenth Day of January, 2004

JON W. DUDAS
*Acting Director of the United States Patent and Trademark Office*